US005959224A

United States Patent [19]

McCune

[11] Patent Number: 5,959,224

[45] Date of Patent: Sep. 28, 1999

[54] GUITAR TREMOLO STABILIZING DEVICE

[76] Inventor: Scott D. McCune, 507 E. Iron Ave. Apt. #1, Dover, Ohio 44622

[21] Appl. No.: 08/934,609

[22] Filed: Sep. 22, 1997

[51] Int. Cl.[6] ..... G10D 3/00

[52] U.S. Cl. ..... 84/313

[58] Field of Search ..... 84/312 R, 312 P, 84/313, 298, 307, 740

[56] References Cited

U.S. PATENT DOCUMENTS

| | | | |
|---|---|---|---|
| 4,141,271 | 2/1979 | Mullen | 84/312 P |
| 4,555,970 | 12/1985 | Rose | 84/313 |
| 4,823,669 | 4/1989 | Sarricola, Jr. | 84/313 |
| 4,928,564 | 5/1990 | Borisoff et al. | 84/313 |
| 5,481,955 | 1/1996 | Goto | 84/313 |
| 5,637,817 | 6/1997 | Sherman | 84/313 |
| 5,808,216 | 9/1998 | Fisher, IV | 84/313 |

FOREIGN PATENT DOCUMENTS 2008725 1/1992 Russian Federation .

*Primary Examiner*—David Martin
*Assistant Examiner*—Wesley Scott Ashton
*Attorney, Agent, or Firm*—James A. Hudak

[57] ABSTRACT

A guitar tremolo stabilizing device is disclosed. The stabilizing device is comprised of a base member having a ring-shaped member slidingly attached thereto. One end of the ring-shaped member is attached to a connecting rod which is biased by a compression spring. The opposite end of the ring-shaped member is attached to a section of roller chain which, in turn, is connected to the bridge for a tremolo arm. In the normal operating position of the device, a "pre-load" is applied to the spring causing the ring-shaped member to contact a stop member preventing any lateral movement therebetween, and the section of roller chain is taut. When it is desired to lower the "pitch" of the guitar, the bridge and lever arm are rotated in a first direction causing the ring-shaped member to move laterally with respect to the base member resulting in further compression of the spring while the roller chain section remains taut. If it is desired to increase the "pitch" of the guitar, the bridge and lever arm are rotated in a second direction causing the ring-shaped member to move laterally and contact the stop member preventing any further lateral movement therebetween and causing further compression of the spring while the roller chain section becomes "kinked". If a guitar string breaks, the ring-shaped member moves laterally with respect to the base member and contacts the stop member preventing any further lateral movement therebetween, resulting in the tremolo returning to its tuned state causing the remaining unbroken guitar strings to remain "in tune".

3 Claims, 6 Drawing Sheets

GUITAR TREMOLO STABILIZING DEVICE

TECHNICAL FIELD

The present invention relates, in general, to a stabilizing device for a guitar tremolo system and, more particularly, to a stabilizing device which, upon the breaking of a guitar string, returns the tremolo to its tuned state causing the remaining guitar strings to remain "in tune".

BACKGROUND ART

Guitar tremolo systems typically utilize a bridge assembly which is attached to the front of the guitar and which includes a lever arm that is received through the body of the guitar. A plurality of counterbalance springs are usually mounted in the base of the guitar and are attached to the lever arm. By moving a tremolo arm attached to the bridge, the "pitch" of the guitar strings can be either increased or decreased. A problem arises, however, when a guitar string breaks while the guitar is being played. Upon string breakage, the remaining guitar strings go "out of tune."

Various types of stabilizing devices are available in order to prevent the remaining guitar strings from going "out of tune" when a string breaks, however, such devices typically require that the guitar player physically actuate the device. For example, in U.S. Pat. No. 5, 127,298 (Snape, et al), upon string breakage, the guitar player must push a pin within the device in order to actuate the stabilizing device. Similarly, in U.S. Pat. No. 4,903,568 (Itoh), upon string breakage, the guitar player must actuate a toggle switch to prevent movement of a slider along the surface of a stabilizing plate in order to maintain the remaining unbroken strings in tune. Also, in U.S. Pat. No. 4,882,967 (Rose), upon string breakage, the guitar player must rotate a stop member from the inactive position to the active position in order to cause the remaining unbroken strings to remain in the "tuned" state. Thus, upon string breakage, the guitar player must typically take some type of action and physically actuate some component within the stabilizing device in order to cause the remaining unbroken guitar strings to remain in their "tuned" state. Since string breakage usually occurs while the guitar is being played, immediate actuation of the stabilizing device by the guitar player is usually not possible, and thus, the guitar player must play the guitar in the "untuned" state until the stabilizing device can be actuated.

Because of the aforementioned disadvantages associated with presently available tremolo stabilizing devices for guitars, it has become desirable to develop a stabilizing device which becomes actuated automatically upon string breakage without requiring any action on the part of the guitar player and returns the tremolo to its tuned state causing the remaining unbroken guitar strings to remain "in tune".

SUMMARY OF THE INVENTION

The present invention solves the problems associated with prior art tremolo stabilizing devices and other problems by providing a stabilizing device which utilizes a stop mechanism which, upon guitar string breakage, returns the tremolo to its tuned state and prevents motion of the bridge and lever arm attached thereto. In this manner, upon the breaking of a string, the remaining unbroken strings stay "in tune". The stabilizing device is received within a cavity in the bottom of the guitar body and is comprised of a base member having a ring-shaped member slidingly attached thereto. One end of the ring-shaped member is attached to a connecting rod which is biased by a compression spring. The opposite end of the ring-shaped member is attached to a section of roller chain which, in turn, is attached to the bridge for a tremolo arm. In the normal operating position of the stabilizing device, a "pre-load" is applied to the compression spring causing the ring-shaped member to firmly contact a bushing attached to the base preventing any lateral movement therebetween, and the section of roller chain is straight and taut. When it is desired to lower the "pitch" of the guitar, the bridge and the lever arm are rotated in a clockwise direction causing the ring-shaped member to move laterally from its normal operating position resulting in the further compression of the compression spring. In this case, the roller chain section remains straight and taut. If it is desired to increase the "pitch" of the guitar, the bridge and the tremolo lever arm are moved in the counter-clockwise direction causing the ring-shaped member to return to its normal operating position so as to contact the bushing attached to the base preventing any lateral movement therebetween and causing the compression spring to return to its normal operating position with the pre-load being applied thereto. In this case, the roller chain section becomes "kinked." If, during operation of the guitar, a guitar string breaks, the ring-shaped member returns to its normal operating position so as to contact the bushing attached to the base preventing any lateral movement therebetween. In this manner, the tremolo returns to its tuned state causing the remaining unbroken guitar strings to remain "in tune".

DESCRIPTION OF THE PREFERRED EMBODIMENT

Figure 1:
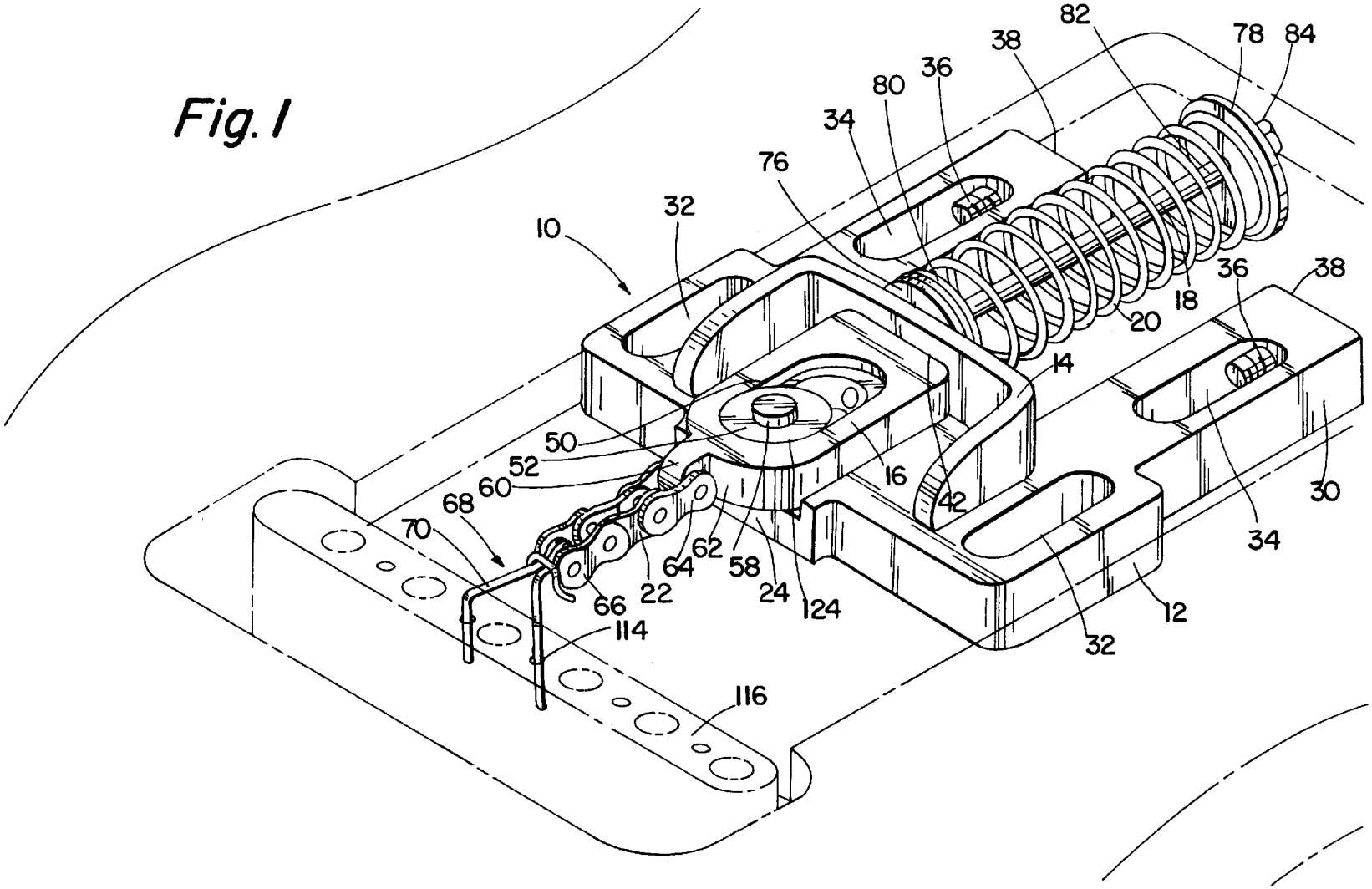
FIG. 1 is a perspective view of the present invention in the normal operating position.

Referring now to the drawings where the illustrations are for the purpose of describing the preferred embodiment of the present invention and are not intended to limit the invention described herein, FIG. 1 is a perspective view of the guitar tremolo stabilizing device 10 of the present invention. The stabilizing device 10 is comprised of a base 12, an upright member 14 attached to the base 12, a movable ring-shaped member 16, a connecting rod 18 having one end thereof received through upright member 14 and connected to one end of movable ring-shaped member 16, a compression spring 20 received over the connecting rod 18, and a section of roller chain 22 attached to the other end of movable ring-shaped member 16.

Figure 2:
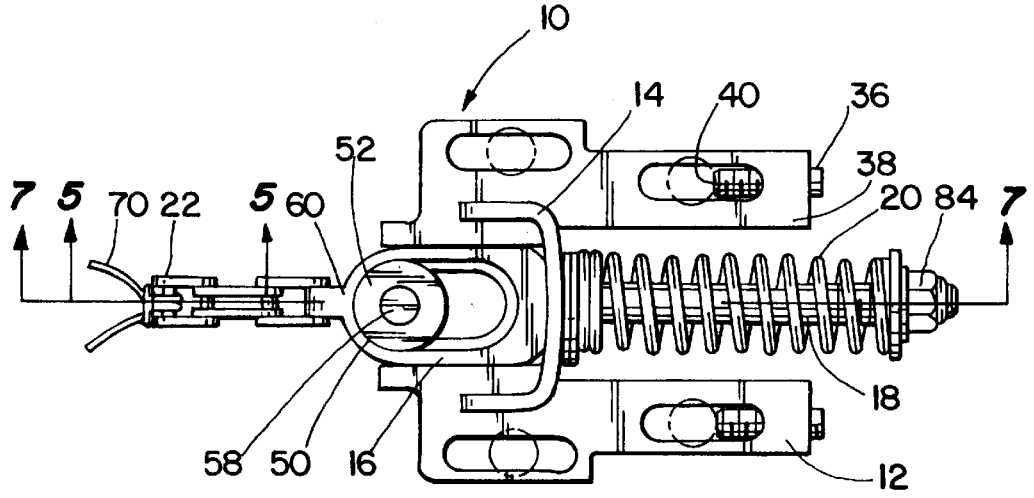
FIG. 2 is a top plan view of the present invention in the normal operating position.

The base 12 is typically U-shaped in configuration with a central portion 24 and outwardly extending legs 30 attached to the opposite ends of central portion 24 and oriented substantially perpendicular thereto. Each leg 30 has two spaced-apart elongated slots 32 and 34 located therein. An Allen head set screw 36 is received through the end 38 of each leg 30 and is oriented so as to be substantially parallel to elongated slots 32 and 34 and is of sufficient length so that its end 40 is within slot 34, as shown in FIG. 2. Upright member 14 is also U-shaped in configuration and is mounted substantially perpendicularly with respect to the central portion 24 of the base 12. The "opening" of the U-shaped upright member 14 is oriented substantially opposite to the "opening" of the U-shaped base 12. An aperture (not shown) is provided in upright member 14 permitting the connecting rod 18 to pass therethrough and permitting the attachment of connecting rod 18 to end 42 of movable ring-shaped member 16.

Figure 5:
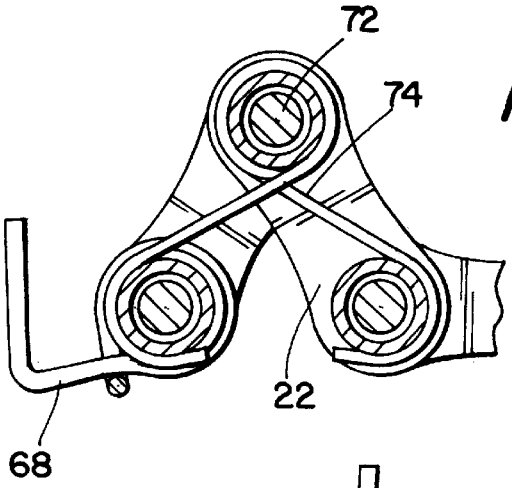
FIG. 5 is a front plan view of the link chain in the "kinked" position.
Figure 6:
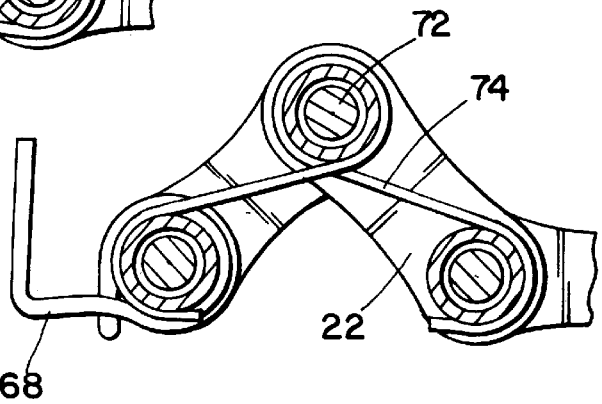
FIG. 6 is a front plan view of the link chain oriented in a position between the "kinked" position and the "taut" position.
Figure 7:
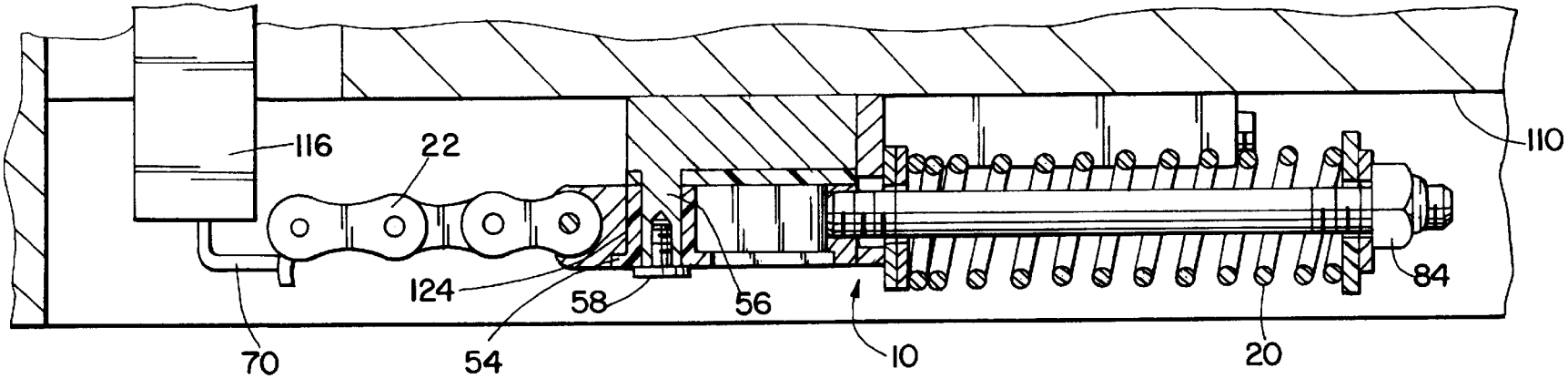
FIG. 7 is a cross-sectional view of the present invention in the normal operating position, corresponding to FIG. 3.
Figure 8:
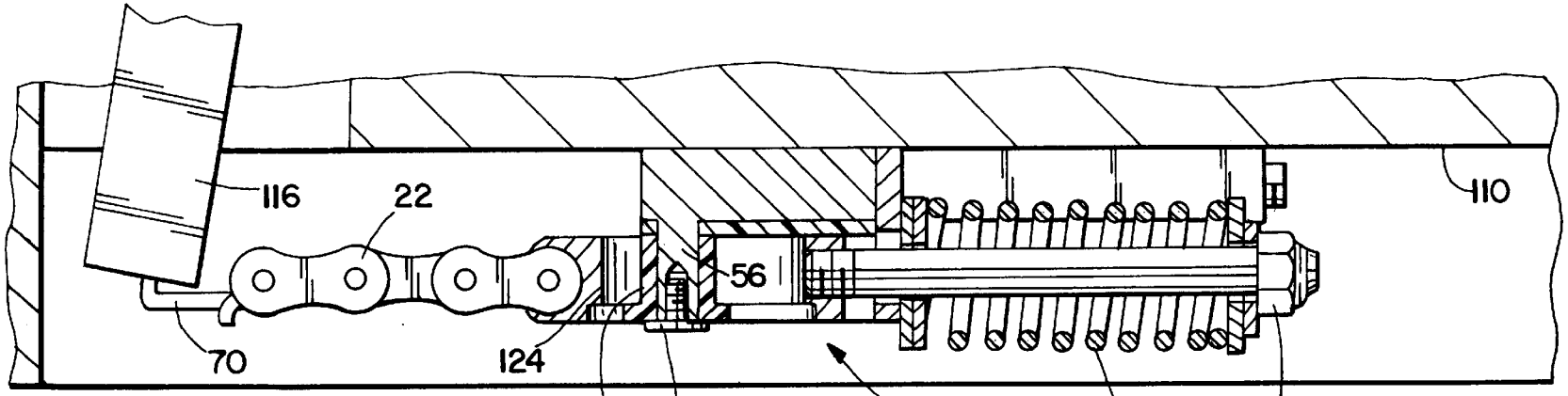
FIG. 8 is a cross-sectional view of the present invention in the "down pitch" position, corresponding to FIG. 4.
Figure 11:
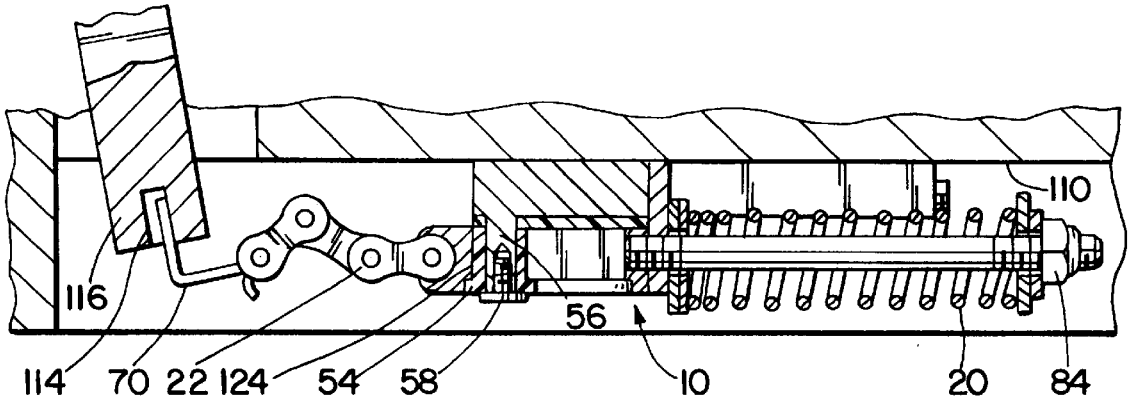
FIG. 11 is a cross-sectional view of the present invention in the "up pitch" position, corresponding to FIG. 10.

Ring-shaped member 16 has an elongated slot 50 provided therein. The slot 50 may be "stepped" permitting the head 52 of a Teflon bushing 54 to be received therein, as shown in FIGS. 7, 8, and 11, or, alternatively, the head 52 of the bushing 54 can be positioned so as to contact the top surface of the ring-shaped member 16. The bushing 54 is received over a post 56 protruding from the central portion 24 of the base 12 and a fastener 58 is threadably received therein to attach bushing 54 to base 12. A Teflon pad (not shown) is interposed between the bottom surface of the ring-shaped member 16 and the top surface of the central portion 24 of the base 12 permitting the ring-shaped member 16 to slide over the top surface of base 12. An ear 60 is provided on end 62 of ring-shaped member 16 permitting end 64 of roller chain section 22 to be attached thereto. The opposite end 66 of roller chain section 22 is provided with a claw arrangement 68 comprising a plurality of spaced-apart claw hooks 70. Roller 72 of roller chain section 22 adjacent claw arrangement 68 has a spring 74 surrounding same, as shown in FIGS. 5 and 6, which biases the section of roller chain attached to the claw arrangement 68 toward its adjacent roller chain section.

Again as shown in FIG. 1, one or more washers 76, 78 are positioned at the opposite ends of compression spring 20. The connecting rod 18 is received through the compression spring 20 and the washers 76, 78 such that washer 76 is interposed between the end 80 of compression spring 20 and upright member 14 and washer 78 is positioned adjacent end 82 of connecting rod 18 which is threaded. A nut 84 is threadably received on the threaded end 82 of connecting rod 18 and compresses compression spring 20 between washers 76, 78.

The stabilizing device 10 of the present invention is designed to be utilized in conjunction with a conventional tremolo system of a guitar. As shown in FIGS. 3, 4, 7, 8, 9, 10, and 11, the stabilizing device 10 is positioned within a cavity 110 provided in the bottom of the guitar body 112 and is attached thereto by means of fasteners received through elongated slots 32 and 34 in base 12. Lateral movement of the stabilizing device 10 is achieved by advancing or retracting Allen head set screws 36 received within threaded apertures in the end 38 of each leg 30 of base 12. Each claw hook 70 within claw hook arrangement 68 is received within a bore 114 provided within the tremolo lever arm 116.

Figure 3:
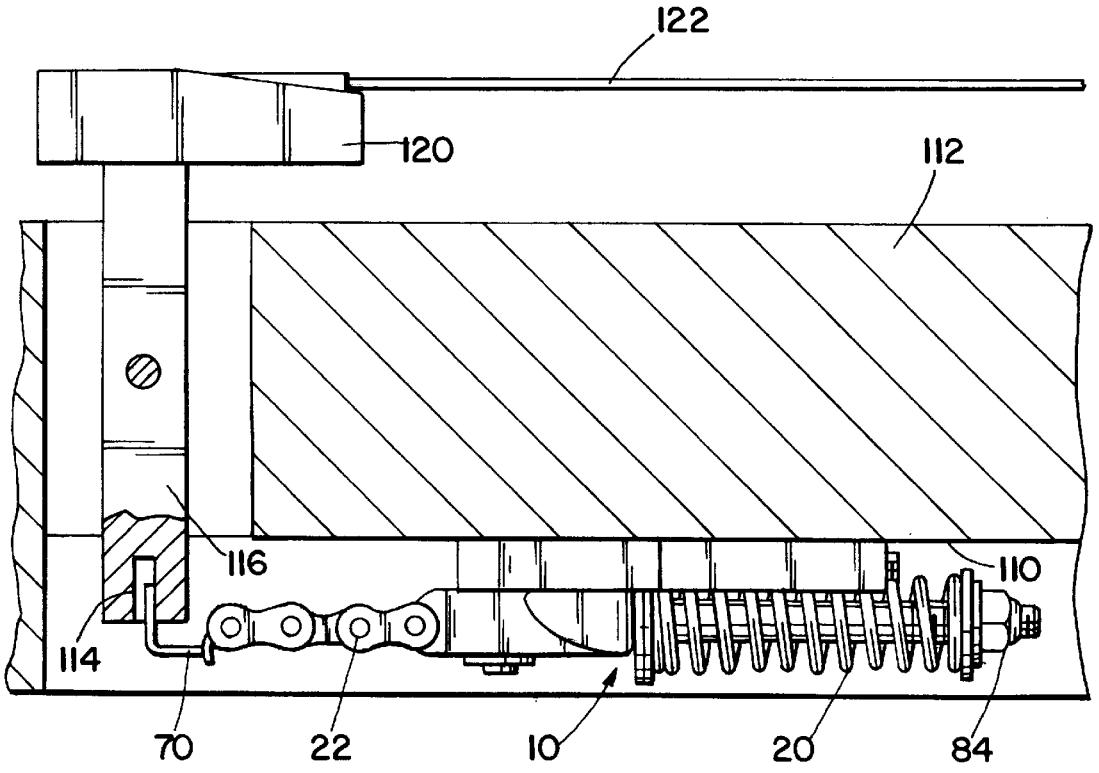
FIG. 3 is a cross-sectional view of the present invention in the normal operating position.

Referring now to FIGS. 3 and 7, a cross-sectional view of a tremolo unit or bridge 120 within a guitar and with the stabilizing device 10 in its normal operating position are illustrated. A tremolo arm (not illustrated) and guitar strings 122 are attached to bridge 120 which is pivotally attached to guitar body 112. In the normal operating position of the stabilizing device 10, a "pre-load" is applied to compression spring 20 by nut 84, bushing 54 contacts surface 124 of elongated slot 50 in ring-shaped member 16 preventing any movement of tremolo lever arm 116 and bridge 120, and roller chain section 22 is substantially straight and taut. The aforementioned "pre-load" is applied to compression spring 20 in order to initially tune the guitar springs, as hereinafter described.

Figure 4:
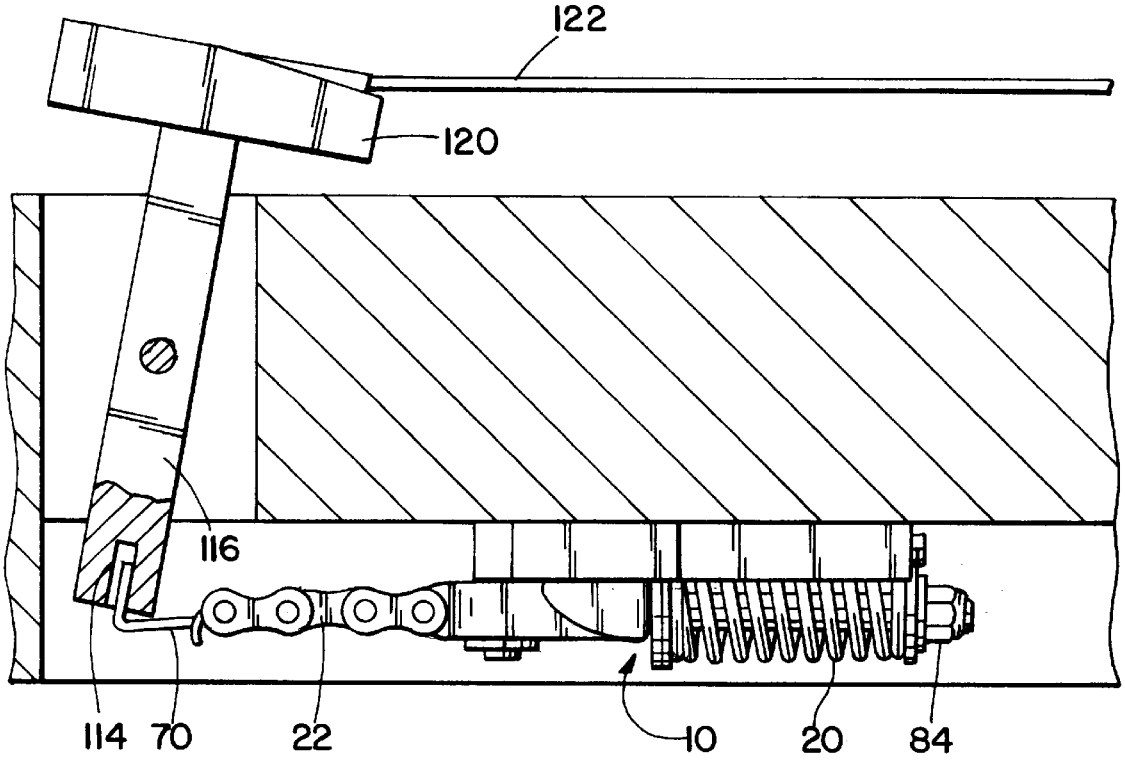
FIG. 4 is a cross-sectional view of the present invention in the "down pitch" position.

Referring now to FIGS. 4 and 8, when it is desired to lower the "pitch" of the guitar, the tremolo arm (not illustrated) and bridge 120 are rotated clockwise causing the ring-shaped member 16 to move to the left resulting in bushing 54 becoming disengaged from surface 124 of elongated slot 50 in ring-shaped member 16 and resulting in the further compression of compression spring 20. In this case, roller chain section 22 remains substantially straight and taut.

Figure 10:
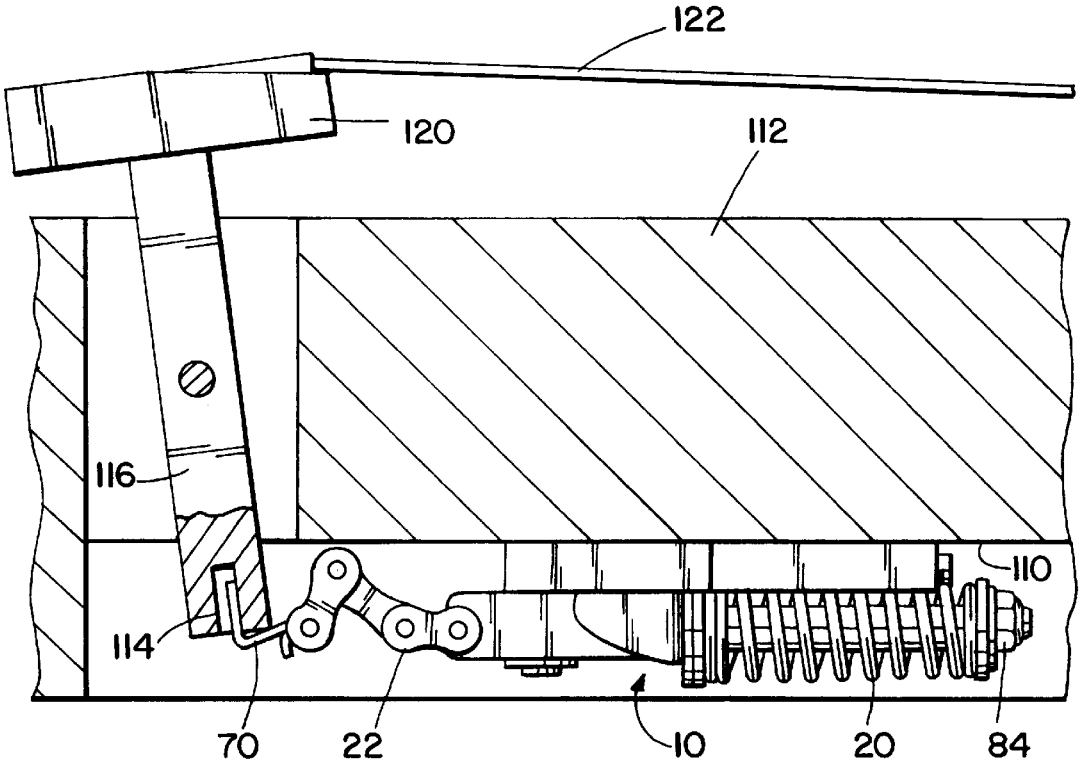
FIG. 10 is a cross-sectional view of the present invention in the "up pitch" position.

If it is desired to increase the "pitch" of the guitar, the tremolo arm (not illustrated) and bridge 120 are moved in the counter-clockwise direction, as shown in FIGS. 10 and 11. In this case, the stabilizing device 10 returns to its normal operating position, the bushing 54 contacts surface 124 of elongated slot 50 in ring-shaped member 16, the compression spring 20 returns to its normal operating state with the pre-load being applied thereto, and the roller chain section 22 becomes "kinked."

If, during operation of the guitar, a guitar string 122 breaks, the stabilizing device 10 reverts to its normal operating position, as illustrated in FIGS. 3 and 7, wherein the bushing 54 contacts surface 124 of the elongated slot 50 within the ringshaped member 16, thus maintaining the remaining unbroken guitar strings in their tuned state. It should be noted that the "pitch" of the remaining unbroken guitar strings will increase, but the strings will remain in tune.

Figure 9:
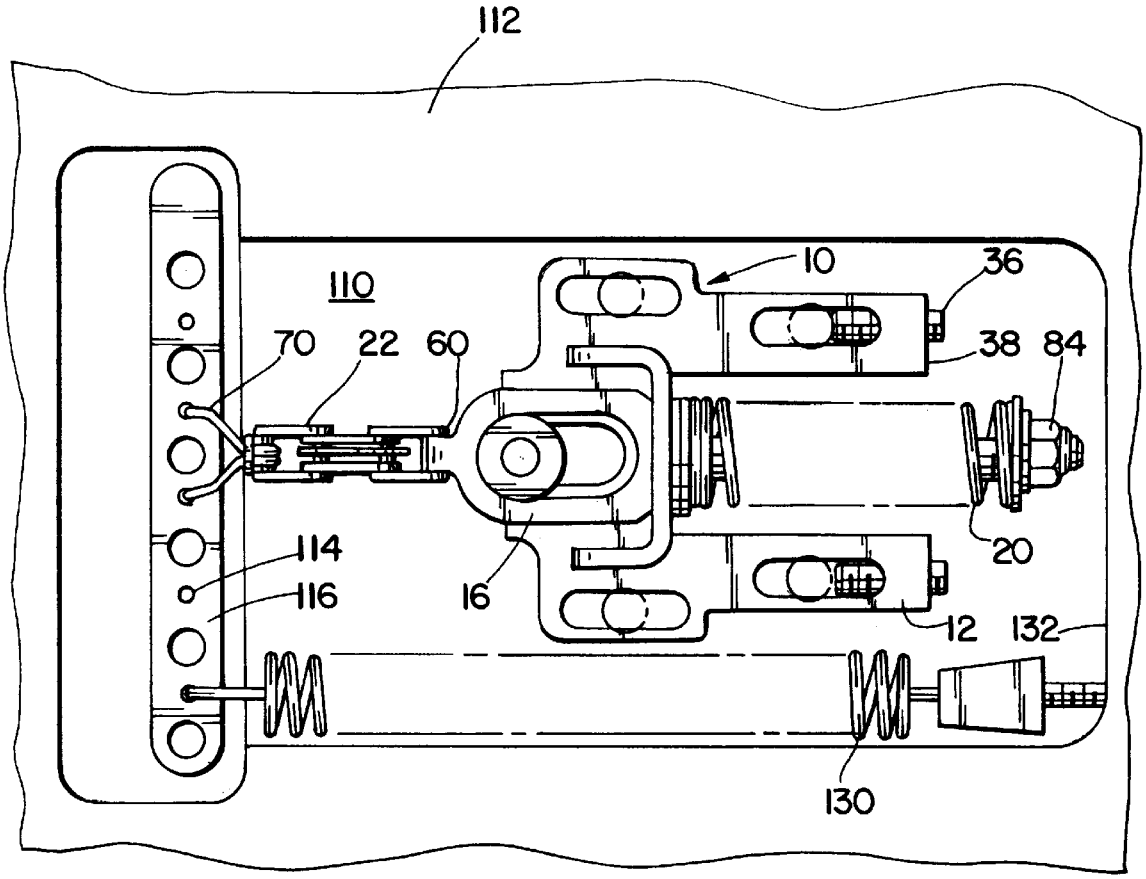
FIG. 9 is a top plan view of the present invention showing an additional spring.

Referring now to FIG. 9, an extension spring 130 can be positioned within cavity 110 provided in the bottom of the guitar body 112 so as to be oriented substantially parallel to the longitudinal axis of the stabilizing device 10. One end of spring 130 is received within a bore 114 in the tremolo lever arm 116 and the other end of spring 130 is operatively attached to the oppositely disposed surface 132 defining cavity 110. Spring 130 "assists" in the movement of ring-shaped member 16 within the stabilizing device 10.

In order to initially tune the guitar with the stabilizing device 10 installed therein, five (5) strings are attached to the guitar and the nut 84 is threadingly advanced on threaded end 82 of connecting rod 18 so as to compress compression spring 20 between washers 76 and 78 until each of the guitar strings is "in tune" and has a light tension applied thereto and bushing 54 contacts surface 124 of elongated slot 50 in ring-shaped member 16, preventing any movement of tremolo lever arm 116 and bridge 120. The sixth string (low E) is then attached to the guitar and nut 84 is again threadingly advanced on threaded end 82 of connecting rod 18 so as to further compress spring 20 until bushing 54 contacts surface 124 of elongated slot 50 in ring-shaped member, preventing any movement of lever arm 116 and bridge 120. When so tuned, a substantially greater tension is applied to the lighter guitar strings and roller chain section

22 is substantially straight and taut, as shown in FIGS. 3 and 7. It should be noted that more tension can be applied to each of the guitar strings in this "tuned" state in order to achieve greater sustain, tone and clarity from the guitar. If a guitar string breaks, the stabilizing device 10 reverts to its normal operating position, as shown in FIGS. 3 and 7, with bushing 54 contacting surface 124 of elongated slot 50 within the ring-shaped member 16, resulting in the tremolo returning to its tuned state causing the remaining unbroken guitar strings to remain "in tune". The pitch of the remaining unbroken guitar strings will increase, but the strings will remain "in tune".

Certain modifications and improvements will occur to those skilled in the art upon reading the foregoing. It should be understood that all such modifications and improvements have been deleted herein for the sake of conciseness and readability, but are properly within the scope of the following claims.

I claim:

1. A guitar tremolo stabilizing device comprising a base member, a member slidingly movable with respect to said base member, means biasing said movable member into a first position with respect to said base member, means operatively connecting said movable member to the guitar tremolo, said connecting means comprising a section of roller chain, movement of the guitar tremolo to lower the pitch of the strings attached thereto causing movement of said movable member from said first position to a second position with respect to said base member and movement of the guitar tremolo to increase the pitch of the strings attached thereto causing said movable member to remain in said first position and causing said connecting means to move from a first position to a second position.

2. The guitar tremolo stabilizing device as defined in claim 1 wherein said roller chain section is in a taut condition when in said first position and is in a kinked condition when in said second position.

3. The guitar tremolo stabilizing device as defined in claim 2 further including means for biasing said roller chain section into a normally kinked condition.

* * * * *